United States Patent [19]

Munir et al.

[11] 3,975,205

[45] Aug. 17, 1976

[54] PROCESS FOR WORKING UP MOLASSES

[75] Inventors: Mohammad Munir; Hubert Schiweck; Hans-Werner Weinz, all of Obrigheim; Fritz Wurm, Offstein, all of Germany

[73] Assignee: Suddeutsche Zucker-Aktiengesellschaft, Mannheim, Germany

[22] Filed: Nov. 27, 1974

[21] Appl. No.: 527,799

[30] Foreign Application Priority Data

Dec. 14, 1973 Germany ..... 2362211

[52] U.S. Cl. ..... 127/46 A; 127/46 R; 210/30 R

[51] Int. Cl.[2] ..... C13J 1/06

[58] Field of Search ..... 127/46 R, 46 A, 46 B; 210/30

[56] References Cited

UNITED STATES PATENTS

| | | | |
|---|---|---|---|
| 2,868,677 | 1/1959 | Kopke | 127/46 B |
| 2,929,746 | 3/1960 | Assalini | 127/46 R |
| 2,971,868 | 2/1961 | Assalini | 127/46 R |
| 3,481,783 | 12/1969 | von der Linde | 127/46 R |
| 3,767,526 | 10/1973 | Suzuki | 127/46 A |
| 3,785,864 | 1/1974 | Laver | 127/46 A |

*Primary Examiner*—Morris O. Wolk
*Assistant Examiner*—Sidney Marantz
*Attorney, Agent, or Firm*—Burgess, Dinklage & Sprung

[57] ABSTRACT

Process for separating sugars from molasses by liquid distribution chromatography according to which molasses are contacted in a special manner with cation exchangers, distributed between at least two columns in the calcium form and by eluting also in a special manner the loaded cation exchangers with decarbonized water.

10 Claims, 2 Drawing Figures

Figure 1:
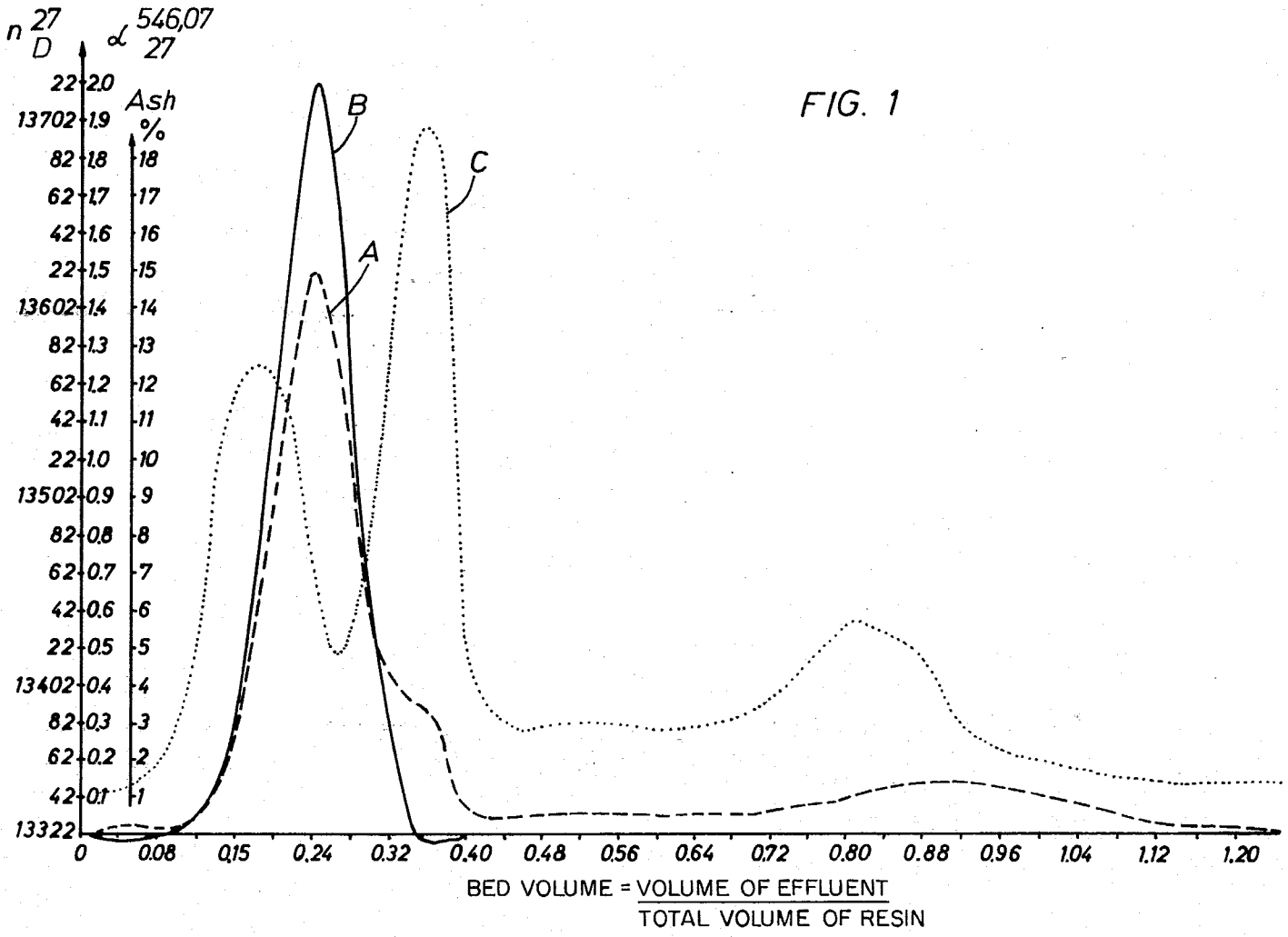

A
B
C
$n_D^{27}$
$\alpha_{546,07}^{27}$
Ash %
BED VOLUME = VOLUME OF EFFLUENT / TOTAL VOLUME OF RESIN

PROCESS FOR WORKING UP MOLASSES

This invention relates to a process for separating sugar from solutions of molasses.

Molasses solutions normally accumulate as final runnings in the recovery of sugar from sugar beet and sugar cane (Ullmann 19, pages 233 to 244, 3rd Edition (1969). Molasses solutions are known to contain nonsugars (Ullmann 19, page 233, 3rd Edition (1969), which prevent the sugar from crystallizing from the molasses and which have to be separated off if the sugar is to be obtained in crystalline form from the molasses.

It is already known that the nonsugars can be separated in the product sequence nonsugars-sugars by means of weakly crosslinked cation exchangers in the alkaline form (D. Gross, Int. Sugar J. 73, 1971, pages 298 to 301 and 330 to 334). One disadvantage of this process is that the ion exchanger becomes charged, for example, with the calcium and magnesium ions present in the molasses, with the result that separation is adversely affected. The molasses solution to be purified is softened before separation in this particular process in order to eliminate the influence of calcium and magnesium ions.

It is also known that molasses solutions can be separated into sugars and nonsugars on cation exchangers in the calcium form (Yushi Ito, Proc. Res. Soc. Japan Sugar Refineries Technol. 22, 1970, pages 1 to 12). Consistent with the distribution constants characteristic of separation which are also described in that publication, it has been found that the separation of molasses solutions is not as effective on cation exchangers in the calcium form as it is on cation exchangers in the sodium or potassium form.

It has now been found that molasses can be separated into sugars and nonsugars by liquid distribution chromatography on cation exchangers in the calcium form in ion-exchange columns arranged one behind the other, providing the entire bed volume of the cation exchanger in the calcium form is distributed between at least two columns in a ratio of from 55 – 75% by volume to 45 – 25% by volume, and a molasses solution is initially applied to the first column, followed by elution with decarbonized water until sugar can be detected in the effluent from this first, and the second column is subsequently connected with the first column until sugar can also be detected in the effluent from this second column, and the second column is separated again from the first column, and finally the non-sugars are eluted from the first column and the sugars are eluted from the second column using decarbonized water.

The process according to the invention can be carried out with gel-form and/or macroporous cation exchanger resins known per se which contain ion-exchanging groups, for example sulphonic acid or carboxylic acid groups. The gel-form cation exchangers are, for example, copolymers of monomeric monovinyl and polyvinyl compounds. To obtain macroporous cation exchanger resins, copolymerization of the monomeric monovinyl and polyvinyl compounds is carried out in the presence of compounds which act as solvents for the monomeric monovinyl and polyvinyl compounds, but in which the copolymers are neither soluble nor swellable. Solvents suitable for use in the production of macroporous cation exchangers are, for example, petrol, dodecane, cyclohexanol, methanol, amyl alcohol, dodecanol, isodecane, oleic alcohol and nitromethane.

The production of the macroporous and gel-form ion-exchanger resins is known per se (e.g. Kirk-Othmer, Encyclopedia of Chemical Technology, 2nd edition, Vol. 11, pages 871 – 879). The production of the macroporous cation exchangers is furthermore described, e.g. in U.S. Pat. No. 3,586,646 (British Pat. No. 894,391).

The following are examples of monovinyl compounds suitable for use in the production of the copolymers: acrylic acid, methacrylic acid, acrylonitrile, acrylic acid esters, methacrylic acid esters, vinyl anisole, vinyl naphthalene, methyl acrylate, ethyl acrylate, propyl acrylate, isopropyl acrylate, butyl acrylate, tert.-butyl acrylate, ethyl hexyl acrylate, cyclohexyl acrylate, isobornyl acrylate, benzyl acrylate, phenyl acrylate, alkyl phenyl acrylate, ethoxy methyl acrylate, ethoxy ethyl acrylate, ethoxy propyl acrylate, propoxy methyl acrylate, propoxy ethyl acrylate, propoxy propyl acrylate, ethoxy phenyl acrylate, ethoxy benzyl acrylate, ethoxy cyclohexyl acrylate, ethyl methacrylate, propyl methacrylate, isopropyl methacrylate, butyl methacrylate, tert.-butyl methacrylate, ethyl hexyl methacrylate, cyclohexyl methacrylate, isobornyl methacrylate, benzyl methacrylate, phenyl methacrylate, alkyl phenyl methacrylate, ethoxy methyl methacrylate, ethoxy ethyl methacrylate, ethoxy propyl methacrylate, propoxy methyl methacrylate, propoxyethyl methacrylate, propoxy propyl methacrylate, ethoxy phenyl methacrylate, ethoxy benzyl methacrylate, ethylene, propylene, isobutylene, diisobutylene, styrene, vinyl toluene, vinyl chloride, vinyl acetate and vinylidene chloride.

It is also possible to use polyethylenically unsaturated monomers, such as isoprene, butadiene and chloroprene, and also heterocyclic monovinyl compounds, such as vinyl pyridine, 2-methyl-5-vinyl pyridine, 2-ethyl-5-vinyl pyridine, 3-methyl-5-vinyl pyridine, 2,3-dimethyl-5-vinyl pyridine, 2-methyl-3-ethyl-5-vinyl pyridine, 2-methyl-5-vinyl isoquinoline and vinyl pyrrolidone.

Styrene and ethyl styrene are particularly preferred.

The following are mentioned as examples of polyvinyl compounds suitable for use in the preparation of the copolymers: divinyl benzene, divinyl pyridine, divinyl toluene, divinyl naphthalene, trivinyl cyclohexane, diallyl phthalate, ethylene glycol diacrylate, ethylene glycol dimethacrylate, divinyl xylene, divinyl ethyl benzene, divinyl sulphone, polyvinyl or polyallyl ethers of glycol, glycerol and pentaerythritol, divinyl ketone, divinyl sulphide, allyl acrylate, diallyl maleate, diallyl fumarate, diallyl succinate, diallyl carbonate, diallyl malonate, diallyl oxalate, diallyl adipate, diallyl sebacate, divinyl sebacate, diallyl tartrate, diallyl silicate, triallyl tricarballylate, triallyl aconitate, triallyl citrate, triallyl phosphate, N,N'-methylene diacrylamide, N,N'-methylene dimethacryl amide, N,N'-ethylene diacrylamide, 1,2-di-($\alpha$-methyl methylene sulphonamide)-ethylene, trivinyl benzene, trivinyl naphthalene and polyvinyl anthracene.

It is particularly preferred to use divinyl benzene and trivinyl benzene.

The quantity in which the polyvinyl compounds are used may vary within wide limits. In general, the polyvinyl compounds are used in quantities of from about 2 to 70% by weight, based on the total quantity of monomer. They are preferably used in quantities of from 3 to 20% by weight in the process according to the invention.

The cation exchangers are used in the calcium form. The cation exchanger is converted into the calcium form in known manner for example by charging the cation exchanger to saturation with a 1 to 10% by weight, preferably 4 to 6% by weight, calcium chloride solution adjusted to a pH-value of above 9 with calcium oxide.

Instead of the calcium chloride solution there can be used a concentrated, e.g. to about 10 to 20% by weight of dry substance, fraction of nonsugars, the cations of which are mainly calcium ions.

Instead of the calcium chloride solution there can be furthermore used the sugar containing fraction, since the cations of this fraction are mainly calcium ions. This fraction can be used directly, that means with its dry substance content of about 10% by weight, or after concentrating to a dry substance content of about 20 to 30% by weight. By this procedure there is achieved at the same time a softening of the sugar containing fraction. This procedure is advantageously applied in all cases where the sugar containing fraction is processed together with the raw juice in the juice station.

Separation by the process according to the invention is carried out in at least two successive ion-exchanger columns between which the entire bed volume of the cation exchanger is distributed in a ratio of from 55 – 75% by volume to 45 – 25% by volume, preferably 60 – 70% by volume to 40 – 30% by volume. In the process according to the invention, the separation effect depends on the concentration of the molasses solution to be separated. The cation exchanger is charged with molasses solution with a concentration of from 40 to 65% by weight, preferably from 45 to 55% by weight, of dry substance.

The quantity in which the molasses solution is applied to the cation exchanger depends on the purity (i.e. by the percentage sugar content, based on dry substance) of the molasses. Where the molasses has a purity in the range of from 60 to 70%, the quantity of molasses solution applied is such that is corresponds to 17 to 19 g of molasses sugar per liter of ion exchanger resin. Where the purity of the molasses is less than 60%, the quantity in which the molasses solution is applied is determined by the nonsugar content. In this case, the molasses solution to be applied to the cation exchanger contains from 10 to 14 g of nonsugars per liter of ion exchanger resin.

Separation is generally carried out at temperatures in the range of from 50° to 99°C and preferably at temperatures in the range from 85° to 95°C.

The molasses solution is applied and the sugars are eluted from the column at a linear rate of flow of from 2.0 to 6.0 cm/minute and preferably at a linear rate of flow of 3 to 4 cm/minute. For elution of the nonsugars, the linear flowrate is increased from 3 cm/minute to 12 cm/minute.

The sugars and nonsugars which accumulate during separation of the molasses solutions are eluted with decarbonized water prepared by adding calcium oxide to water and adjusted to a pH-value of above 9.

After the sugars and nonsugars have been eluted, more molasses solution may be applied to the cation exchanger. The sequence of operations from application of the molasses solution to elution of the sugars and nonsugars is hereinafter referred to as a cycle.

In contrast to D. Gross, Int. Sugar J. 73, 1971, pages 298 to 301 and 330 to 334, and Yushi Ito, Proc. Res. Soc. Japan Sugar Refineries Technol. 22, 1970, pages 1 to 12, the elution sequence is reversed in the process according to the invention. High molecular weight substances (for example, colored compounds, waxes, polysaccharides and raffinose) are eluted to begin with, followed by disaccharides and monosaccharides in the order saccharose, glucose, fructose, and then by monomeric nonsugars (for example salts of amino acids, carboxylic acids and mineral acids and betaine).

Figure 2:
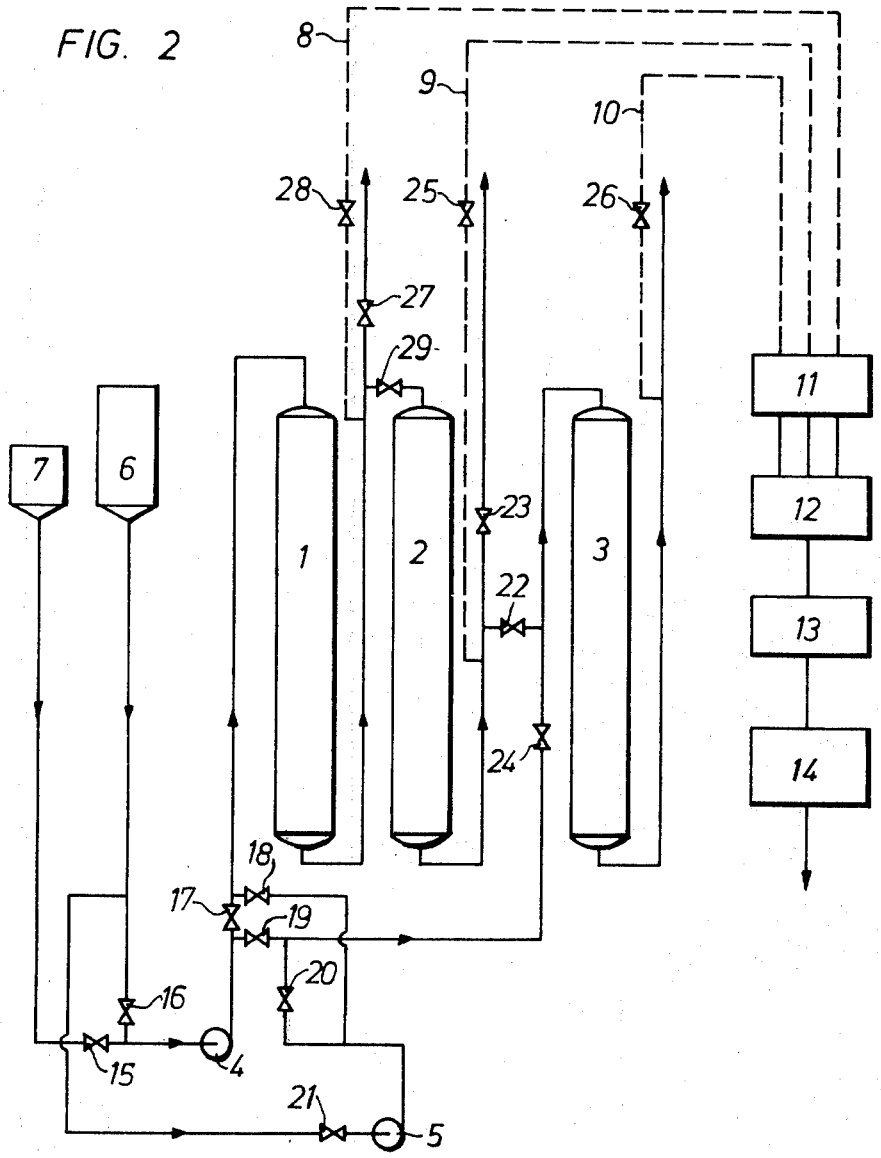

The invention will be further described with reference to the accompanying drawings wherein:

FIG. 1 is a plot of refractive index, optical rotation and ash content against the quotient of liquid volume divided by ion-exchanger volume; and FIG. 2 is a flow sheet of an apparatus for carrying out the novel process.

The product sequence in the separation of beet molasses is shown for one cycle in FIG. 1 in dependence upon bed volume (i.e. in dependence upon the quotient of the liquid volume and the ion-exchanger volume). Curve A shows the dependency of the refractive index ($n_D^{27}$), Curve B the dependency of optical rotation ($\alpha_{27}^{546,07}$) and Curve C the dependency of the ash content (%) of the eluates from the bed volumes. Refractive index is used as a measure of dry substance content, optical rotation as a measure of sugar content and ash content as a measure of salt content. The ash content was determined by measuring the conductivity and recalculating the conductivity values according to the ICUMSA Directives, Report of the Proceedings of the 15th Session, London (1970).

When working according to the process of the invention and investigating analytically according to the ICUMSA Directives the eluate obtained in fractions of one cycle it can be shown that maximum colored compounds elution is obtained at bed volumes of 0.06 and 0.48, maximum raffinose elution is obtained at a bed volume of 0.14, maximum saccharose elution is obtained at a bed volume of 0.24, maximum amino acid elution is obtained at a bed volume of 0.48 and maximum betaine elution is obtained at a bed volume of 0.80. In the separation of cane molasses by the process according to the invention there is obtained at a bed volume of 0.41 in addition maximum of invert sugar elution. The sugar-containing fraction to be separated off and to be obtained is between the bed volumes 0.13 and 0.31. The average dry substance content of the sugar-containing fraction is between 5 and 12% by weight.

In addition to chromatographic separation, the entire bed volume of the ion exchanger becomes progressively charged with alkali metal ions (potassium and sodium) from the molasses. At the same time, the exchanged calcium leaves the column together with the sugar and nonsugar fractions. For this reason, the columns are advantageously regenerated after a number of cycles with basic calcium chloride solution, concentrated nonsugar fraction or with sugar containing fraction.

The installation retains also its full separation effect when the first column is partly e.g. less than about 100%, charged with alkali metal ions. The separation effect only deteriorates when the alkali metal ions have advanced up to the second column. It is possible, by limiting the number of cycles carried out between two regenerations, to prevent alkali metal ions from advancing to the second column. In this case, it is only necessary to regenerate the first column. In one advantageous embodiment of the process according to the invention, the first column is divided into two equal halves which in turn are divided between two or more successive ion exchanger columns and of which only the first half is regenerated when the second half begins to become charged with alkali metal ions, which can be detected by analytically determining the equilibrium state between the calcium and alkali metal form of the ion exchanger resin.

EXAMPLE

The test installation (cf. FIG. 2) for separating the molasses into various groups of substances consists of three columns 1, 2 and 3 of equal size arranged one behind the other (diameter 0.25 m, resin height 3.60 m, bed volume of the installation 500 liters of ion exchanger resin). 65% by volume of the total bed volume are divided in equal parts between columns 1 and 2, while 35% by volume of the total bed volume of a standard commercial microporous cation exchanger with sulphonic acid groups in the calcium form, cross-linked with 4% of divinyl benzene, is placed in column 3. The installation further comprises two displacement pumps (4 and 5), storage vessel for water (6) and a storage vessel for molasses (7). A tempering system keeps the columns, the water and the molasses at a temperature of 90°C. For product detection, there are taken off through sampling pipes 8, 9 and 10 sample streams of the effluents from the individual columns. The streams are cooled to 27°C in thermostat (11) and passed successively through the measuring cells of a polarimeter (12), a refractograph (13) and a conductivity meter (14).

METHOD

1. Valves 15, 17, 29, 23 and 25 are opened. All the other valves are closed. Pump 4 is switched on and 30 liters (6% by volume of the bed volume) of the molasses solution heated to 90°C (dry substance content 50% by weight, purity 61%) are pumped to column 1 at a linear flowrate of 3.4 cm/minute.

2. After the molasses solution has been introduced, the valve 15 is closed and valve 16 is opened. The columns 1 and 2 are then eluted with water at 90°C decarbonized with calcium oxide. When sugar is detected in the eluate from the second column, column 3 is connected to it. The valves 16, 17, 29, 22 and 26 are now opened. The pump 4 continues to pump decarbonized water at 90°C through all the columns at a flowrate of 3.4 cm/minute.

3. When the eluate from column 2 is sugar-free, the valves 17 and 22 are closed, the valves 21, 18, 19, 24, 23 are opened and pump 5 switched on.

4. The sugar fraction in column 3 is then eluted from the column with decarbonized water at 90°C pumped through at a flowrate of 3.4 cm/minute (pump 4). The nonsugars are in columns 1 and 2. They are washed out of the columns with decarbonized water at 90°C pumped through at a flowrate of 5.1 cm/minute (pump 5).

5. The sugar fraction in column 3 is collected until a polarimeter reading of 0.45° is reached. The following eluate is collected together with the nonsugar fraction from column 2.

6. When column 3 is free from sugar, the valves 19 and 18 are closed, the valves 17 and 20 are opened and all the columns are washed free with decarbonized water at 90°C. The installation is again ready for use after a cycle time of 3 hours.

The results of nine cycles between two regenerations are set out in Table 1. The volume of the sugar-containing fraction is between 91 and 98 liters. If the volume of the sugar-containing fraction is based on the bed volume of the ion exchanger resin, it is between the values 0.196 and 0.182. The dry substance content of the sugar-containing fraction is between 9.55 and 10.5%. It can be seen from the results that an average of 96.8% of the molasses sugar originally introduced is recovered with a purity of on average 91.9%, an average of 87.0% of the nonsugar in the molasses having been separated off.

The sugar-containing fractions from cycles 1 to 9 are concentrated by evaporation to a dry substance content of 70%. After crystallization in three stages, 85% of the sugar are recovered in crystalline form, based on the sugar present in the product fraction.

Table 1

| Cycle | 1 | 2 | 3 | 4 | 5 | 6 | 7 | 8 | 9 | Average over 9 cycles |
|---|---|---|---|---|---|---|---|---|---|---|
| Volume of sugar-containing fraction, based on the bed volume of the ion exchanger resin | 0.196 | 0.186 | 0.188 | 0.186 | 0.184 | 0.182 | 0.186 | 0.184 | 0.182 | 0.186 |
| Dry substance content % | 9.55 | 10.4 | 10.3 | 10.3 | 10.2 | 10.2 | 10.1 | 10.2 | 10.5 | 10.2 |
| Purity % | 93.0 | 92.1 | 91.2 | 92.0 | 93.0 | 92.7 | 92.4 | 91.2 | 89.5 | 91.9 |
| Yield, based on the molasses sugar used (%) | 96.9 | 98.9 | 98.4 | 97.8 | 97.0 | 95.9 | 96.6 | 95.1 | 95.0 | 96.8 |

We claim:

1. A process for separating molasses into sugars and nonsugars by liquid distribution chromatography on cation exchangers in the calcium form in ion exchange columns arranged in series, comprising a. placing 55–75% of the total cation exchanger in a first column and the remaining 45 to 25% in a second column, b. supplying molasses to the first column, c. eluting said first column with decarbonized water until sugar is detected in the eluate, d. thereafter continuing elution and passing the sugar-containing eluate through said second column until sugar is detected in the eluate from said second column, e. thereafter passing eluant through said second column but not through said first column and collecting the sugar-containing eluate from the second column, f. discontinuing elution of said second column, g. and separately eluting the non-sugars from said first column.

2. A process as claimed in claim 1, wherein the first column contains 60 to 70% of the total cation exchanger in both columns.

3. A process as claimed in claim 1, wherein the molasses supplied to said first column has a solids concentration of 40 to 65% by weight.

4. A process as claimed in claim 1, wherein the process is carried out at a temperature of 50° to 99°C.

5. A process as claimed in claim 1, wherein the molasses is supplied to the first column of the ion exchanger at a linear flow rate of 2.0 to 6.0 cm/minute while the nonsugar fraction is eluted at a linear flow rate of 3 to 12 cm/minute.

6. A process as claimed in claim 1, wherein the sugar and nonsugar fractions are eluted with decarbonized water having a pH above 9.

7. A process as claimed in claim 1 wherein the ion exchangers are regenerated with a concentrated non-sugar fraction obtained in the process.

8. A process as claimed in claim 1 wherein the ion exchangers are regenerated with a sugar-containing fraction obtained in the process.

9. A process as claimed in claim 1, wherein the cation exchanger in calcium form is an olefinic material cross-linked with 3 to 20% by weight of divinylbenzene and includes sulfonic acid groups.

10. A process as claimed in claim 9, wherein the first column is subdivided into two serially arranged sub-columns, 60 to 70% of the total cation exchanger being approximately equally divided between said two sub-columns, the molasses supplied to the first column having a solids concentration of 45 to 55% and being supplied at a linear flow rate of 3 to 4 cm/minute, elution being effected with decarbonized water having a pH above 9, the non-sugar fraction being eluted at a linear flow rate of 3 to 12 cm/minute, the process being carried out at a temperature of 85° to 95°C.

* * * * *